United States Patent [19]

Bellini et al.

[11] Patent Number: 4,676,282

[45] Date of Patent: Jun. 30, 1987

[54] APPARATUS AND METHOD FOR FILLING BOTTLES, FLACONS OR THE LIKE CONTAINER WITH A PREDETERMINED WEIGHT AMOUNT OF A FLUID

[75] Inventors: Omero Bellini, Novellara; Lucio Mantovani; Giulio Menini, both of Pavia, all of Italy

[73] Assignee: LOGIC s.r.l., Pavia, Italy

[21] Appl. No.: 781,818

[22] Filed: Sep. 30, 1985

[30] Foreign Application Priority Data

Oct. 10, 1984 [IT] Italy ..... 23082 A/84

[51] Int. Cl.[4] ..... B65B 3/04

[52] U.S. Cl. ..... 141/1; 141/83; 177/6

[58] Field of Search ..... 141/1-12, 141/68-83; 177/6

[56] References Cited

U.S. PATENT DOCUMENTS 4,467,844 8/1984 Gianfilippo et al. ..... 141/83

4,523,616 6/1985 Schädel et al. ..... 141/83

*Primary Examiner*—Houston S. Bell, Jr.

*Attorney, Agent, or Firm*—Guido Modiano; Albert Josif

[57] ABSTRACT

A control system is disclosed for controlling the filling of bottles, flacons, and the like with a predetermined weight, whereby the value of the weight measured during the filling operation at which the tap associated with every filling zone is turned off, can be corrected automatically. The system comprises device for processing the value of the weight difference between the theoretical value, of the real value of the weight of one bottle, as measured on completion of the filling operation, for every filling zone. Control devices are also provided for processing a correction factor on the basis of the calculated weight difference, to obtain a new value for the weight measured during the filling operation, at which value the tap associated with that channel must be turned off. Also disclosed is the method of weight responsive filling on which the system operates.

10 Claims, 5 Drawing Figures

APPARATUS AND METHOD FOR FILLING BOTTLES, FLACONS OR THE LIKE CONTAINER WITH A PREDETERMINED WEIGHT AMOUNT OF A FLUID

BACKGROUND OF THE INVENTION

This invention relates to a control system and a method for weight filling responsive filling to bottles, flacons, and the like vessels.

As is known, weight responsive vessel filling systems generally comprise a carousel having a platform with a set of housings or loading zones and a plurality of taps, each located above every filling zone, the opening and closing command wherefor is provided by control members, such as solenoid valves, associated with members for checking the weight of the related loading zone. Every loading zone moves, during the carousel rotation, past a loading station for the empty vessels where the vessels are loaded by means of an input star which picks them up from a transport line, during the rotation of the carousel the vessels are filled to a desired weight and thereafter the filled bottles are discharged at an output station comprising a star which is effective to remove the filled bottles and eject those bottles which, following a check on completion of the filling operation, show to have weight values exceeding certain preset tolerances. Known systems further include control systems for checking the presence of the bottle prior to issue the command to open the taps.

To check the weight of the filling fluid and the presence of the bottle various systems are used which are disposed below every filling zone, e.g. by means of a load cell associated with the related filling zone which can issue electric signals correlated to the measured weight.

Such prior systems, in particular those equipped with load cells, however, require some adjustments to take into account the effects occurring due to the impact thrust generated by the free fall of a fluid, and variations related to changes in the ambient environmental conditions which occur whilst filling is being performed. In particular the thrust of the fluid falling freely from above, issuing from the tap, within the vessel generates a force interpreted as weight which, if not taken into account, would lead to false weight measurements. Furthermore, the behavior of every filling station may vary during the working cycle due to changes in the ambient environmental conditions such as changes in temperature, thus causing variations of, for example, the density and temperature of the filling fluid utilized. As a result, the device, additionally to requiring an initial calibration that takes into account the thrust of the falling fluid, also requires corrections throughout the working cycle to take into account the machine's operating conditions.

Such corrections are presently carried out mostly manually, e.g. at set time intervals or on detecting that the deviation of the filled bottles, due to weights outside of the tolerance range, exceeds an acceptable average value. However, that system, which involves the intervention of an operator, is very wasteful of material and machine operating time, both because of the need for the person to be physically present to check the machine's operation, and because prior to effecting the correction the number of discarded vessels is increased owing to their being out of tolerance, or the error existing in every vessel with respect to the nominal value even if within the tolerance range.

SUMMARY OF THE INVENTION

In view of the above situation, the aim underlying this invention is to provide a control system and a method of filling bottles, flacons, and the like vessels by weight, which can apply automatically a correction to the set values of theoretical weight at which the taps are turned off.

Within the above aim, it is a particular object of this invention to provide a said system and said method which can operate in a fully reliable manner, ensuring a reliable and continued following of the correct value to provide filling of the vessels according to the set levels.

Still another object of this invention is to provide a system and a method which can operate automatically without involving manual intervention by operators excepting as regards intentional machine stopping operations.

A not least object of this invention is to provide a system and a method which are highly simple from the design and practical standpoint.

The cited aim, and these and other objects such as will be apparent hereinafter, are achieved by a a system for controlling the filling of bottles, flacons, and the like by weight, comprising a rotating carousel provided with a plurality of filling zones, each associated with one filling tap, means of controlling said filling tap to open it upon detecting the presence of a bottle, flacon, or the like at the associated filling zone and to turn off the tap on detecting the reaching of the desired weight, as well as means of checking the final weight reached and controlling the deviation of the out-of-tolerance bottles, characterized in that it comprises means of processing the value of the deviation existing between the theoretical value and a real value of the bottle weight measured for every filling zone, said means being operatively connected to said control means, as well as correction means operatively connected to said processing means and control means effective to process a correction factor for the closed time of said taps based upon the calculated deviation.

BRIEF DESCRIPTION OF THE DRAWINGS

Further features and advantages will become apparent from the following description of a preferred, but not exclusive, embodiment of the invention, with reference to the accompanying illustrative and not limitative drawings, where.

DESCRIPTION OF THE PREFERRED EMBODIMENTS

Figure 1:
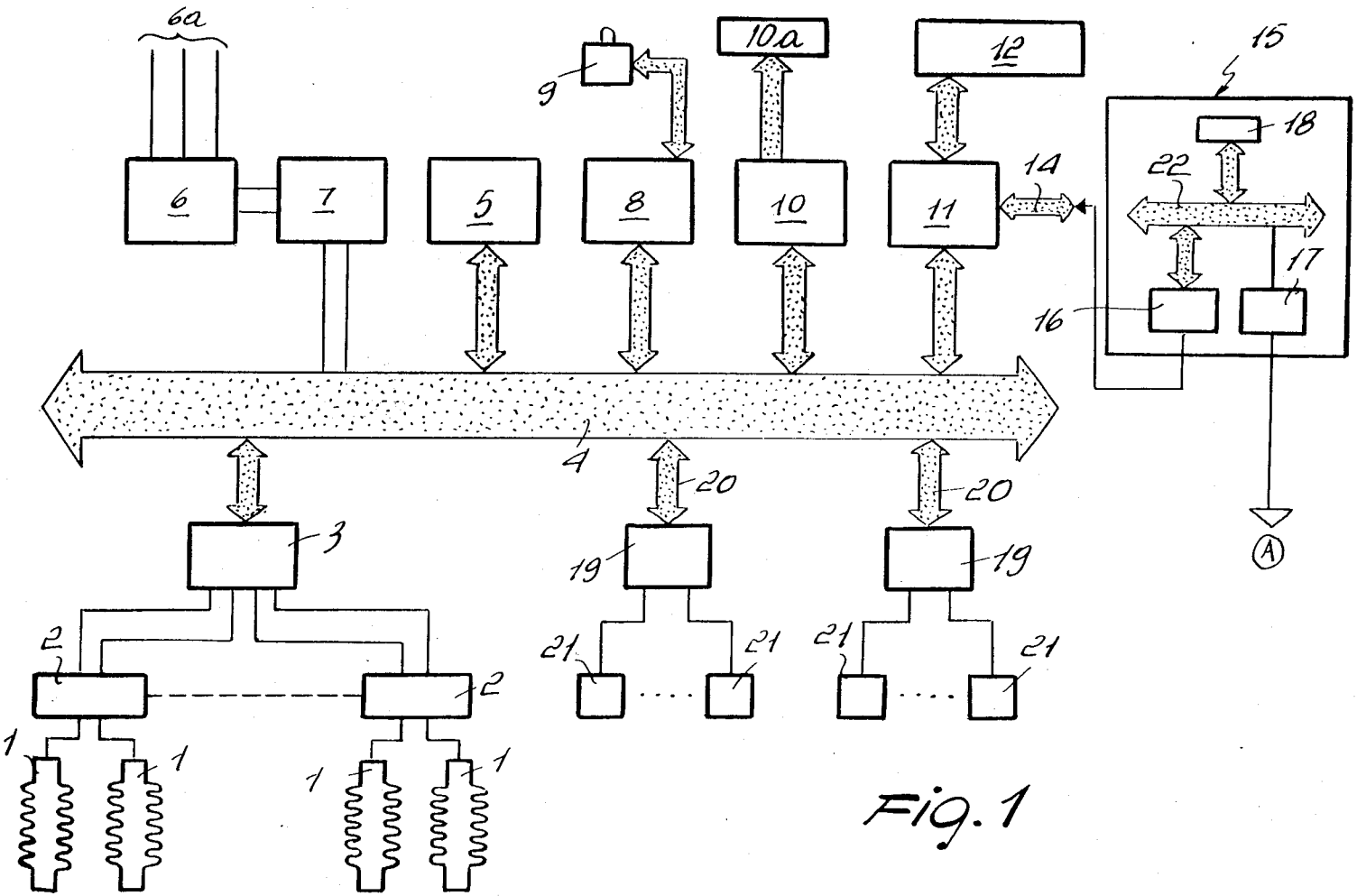
FIG. 1 shows a block diagram of the elements composing the central portion of the system.

With reference to FIG. 1, the system according to the invention comprises a plurality of load cells, indicated at 1, every one associated with a filling zone 64 located on the machine rotating carousel 60. the load cells 1 are connected to amplifier members 2 which provide for the amplifying and possible filtering of the electric signal from the load cells and for supplying it to the multiplexer 3 also functioning as an analog/digital converter so as to output to the transmissive channel 4 or bus each time the digital signal which corresponds to the value of the weight relating to one of the load cells. Connected to the bus 4 are a set of devices and means of processing the signals from the load cells adapted to generate control signals to open and close the taps 63 associated with every filling zone 64. In particular, indicated at 6 is the combination of network filters receiving on the input 6*a* the AC supply and the ground required for the operation of the whole system. To the block 6 there is connected the assembly 7 of the power supplies which power the various devices. Indicated at 5 is the central processing unit comprising the program memories, the memories for maintaining the necessary data to the system operation and buffer batteries for long maintaining the stored data. Indicated at 8 is the input interface operatively connected to an encoder 9 adapted to detect the carousel rotation and signal continuously the exact position of the carousel relatively to the load-bearing frame of the machine. Indicated at 10 is the output unit for issuing the ejection signals, should it happen that the net end weight of the bottle contents does not fall within a certain previously set range of tolerance. That unit 10 is connected to conventional ejection means 10*a*, not shown in further detail.

Indicated at 11, moreover, is an input/output unit connected both to a data input/output console 12 to and from the operator, and to a transmissive channel 15 through the bus 14.

Also connected to the system bus 4 are, through the buses 20, the interface units 19 interposed to the bus 4 and the solenoid valves 21 each controlling the opening and closure of a respective tap 63 according to commands from the central processing unit and then defining filling tap control means 5.

The components described so far represent the basic structure of the system disposed preferably within the system itself and rotating with it. That structure can operate independently or be connected to the external unit for managing the data supplied by the system. For connection to the external system, a transmissive channel 15 of the intelligent type is envisaged which can manage, then, the transmission of data between the central system and the external system. In detail, the channel 15 comprises a pair of talking input/output interfaces 16 and 17 through the bus 22 to a central processing unit 18 which manages the times and standards of the communication. As may be seen, the interface 16 is connected to the bus 14 and then to the interface unit 11, whilst the interface 17 is connected to the external system shown detailedly in FIG. 2.

Figure 2:
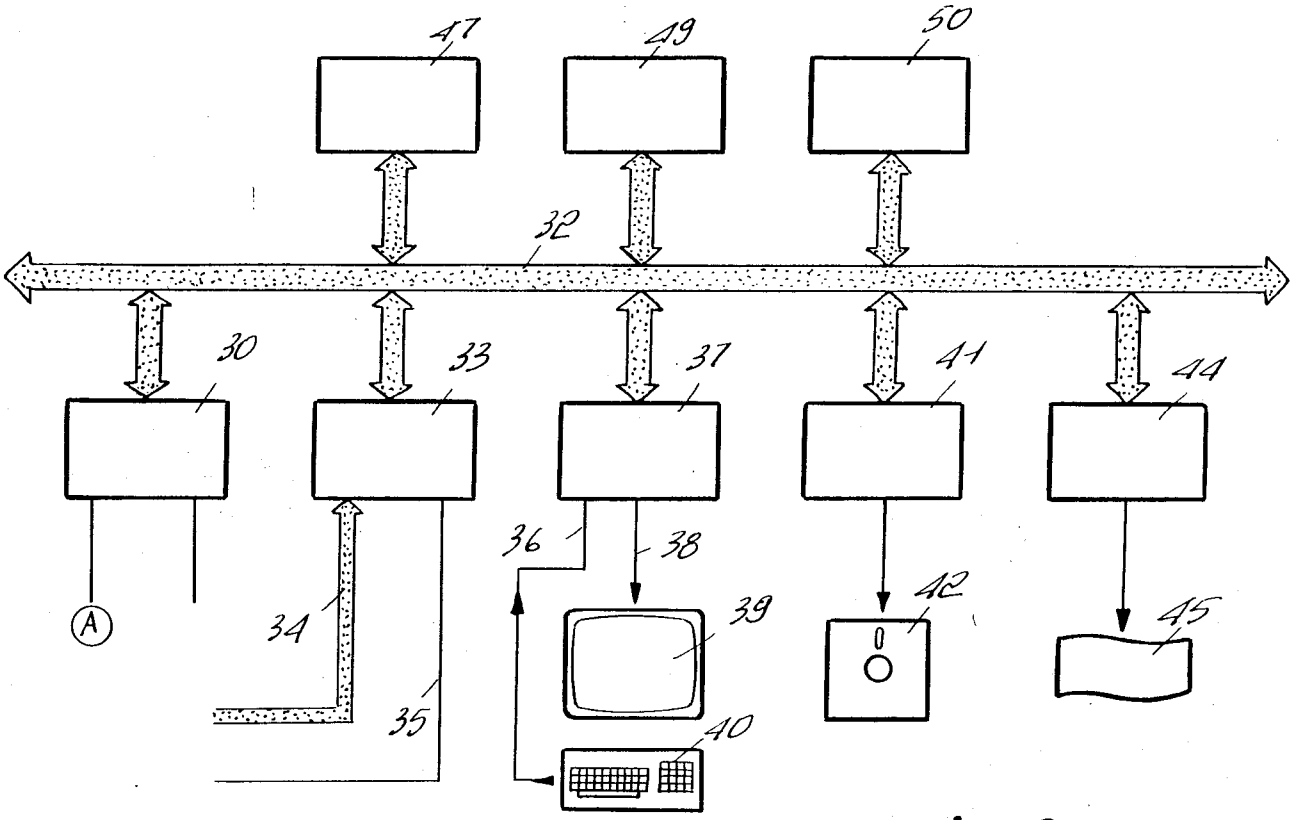
FIG. 2 is a schematical block diagram of the elements composing an external processing unit for the data supplied by the system of FIG. 1.

With reference now to FIG. 2, there is shown diagramatically the structure of the external system. In particular there may be observed a data input interface 30 to which serial data are input from the channel 15. The interface 30 is connected to its internal bus 32, to which are connected all the devices and all the units which make up the external system. In particular at 33 there is indicated an input/output interface to which there are supplied, the warning signals 34 due to stop situations of the machine of an automatic type caused by the operator. On the line 35 there are supplied signal of acceptance for filling through an operator.

Also connected to the bus 32 are an interface 37 connected, through the line 38, to a monitor 39 and a keyboard 40 connected in the line 36. That connection enables talking between the external system and the operator. To the bus 32 there are also connected the unit 41 controlling the floppy disks 42, the printing interface 44 connected to the printer unit 45 and the modules 47,49 and 50 forming respectively the system power supply module, the central processing unit managing the whole system, and a storage module duplicated for safety.

Figure 3B:
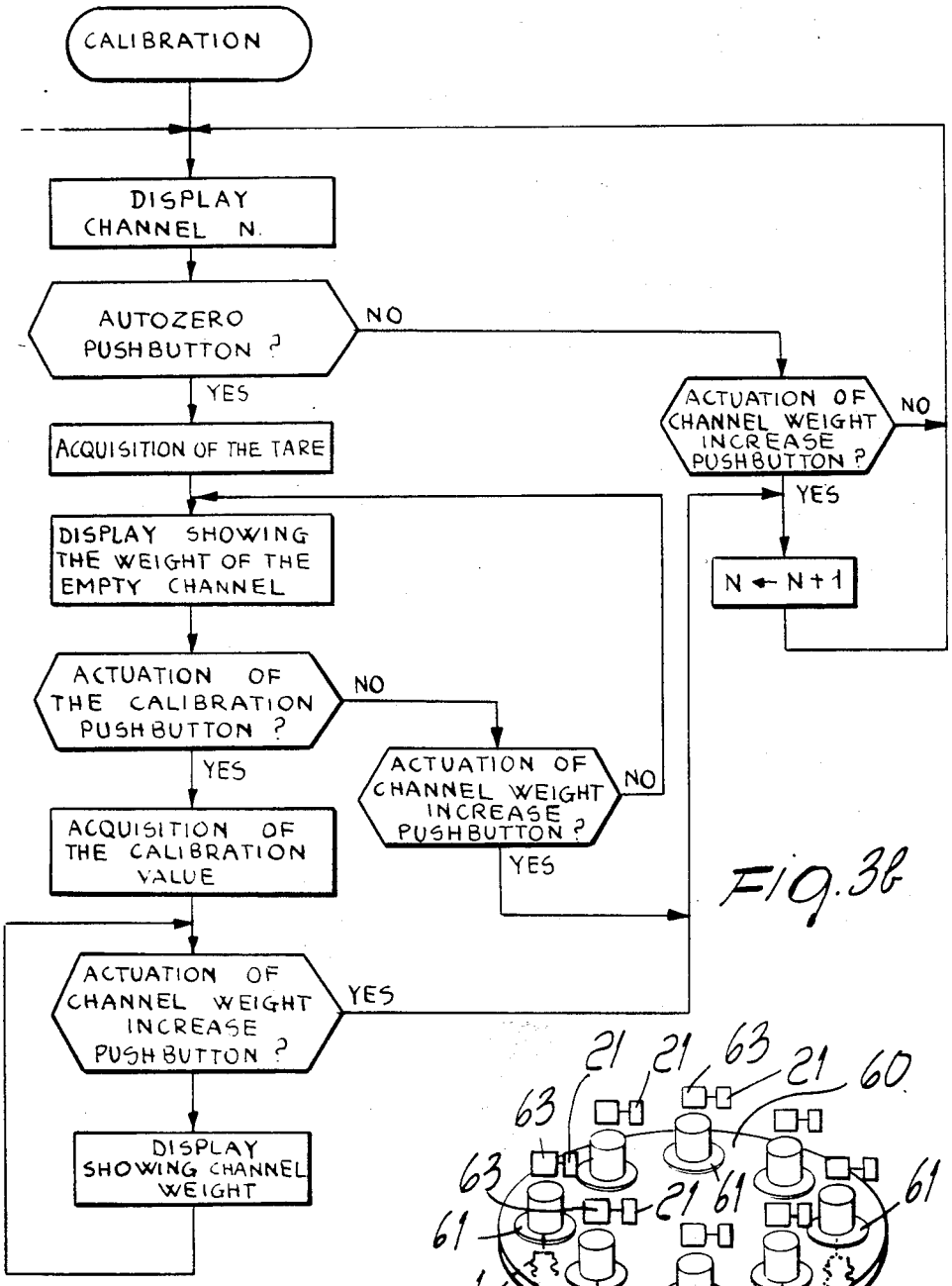
FIGS. 3*a* and 3*b* show block diagrams relating to the method used, for a clearer understanding thereof.
Figure 1A:
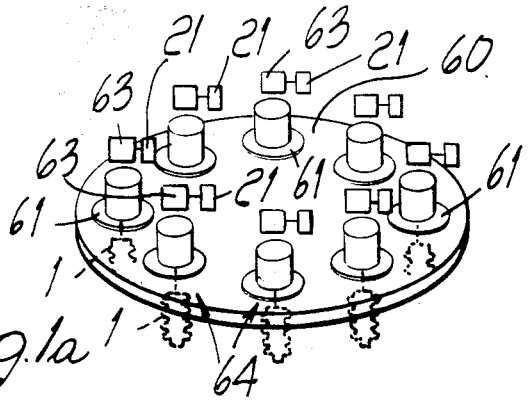
FIG. 1*a* shows schematically the rotating carousel and relating filling and weighting members.
Figure 3A:
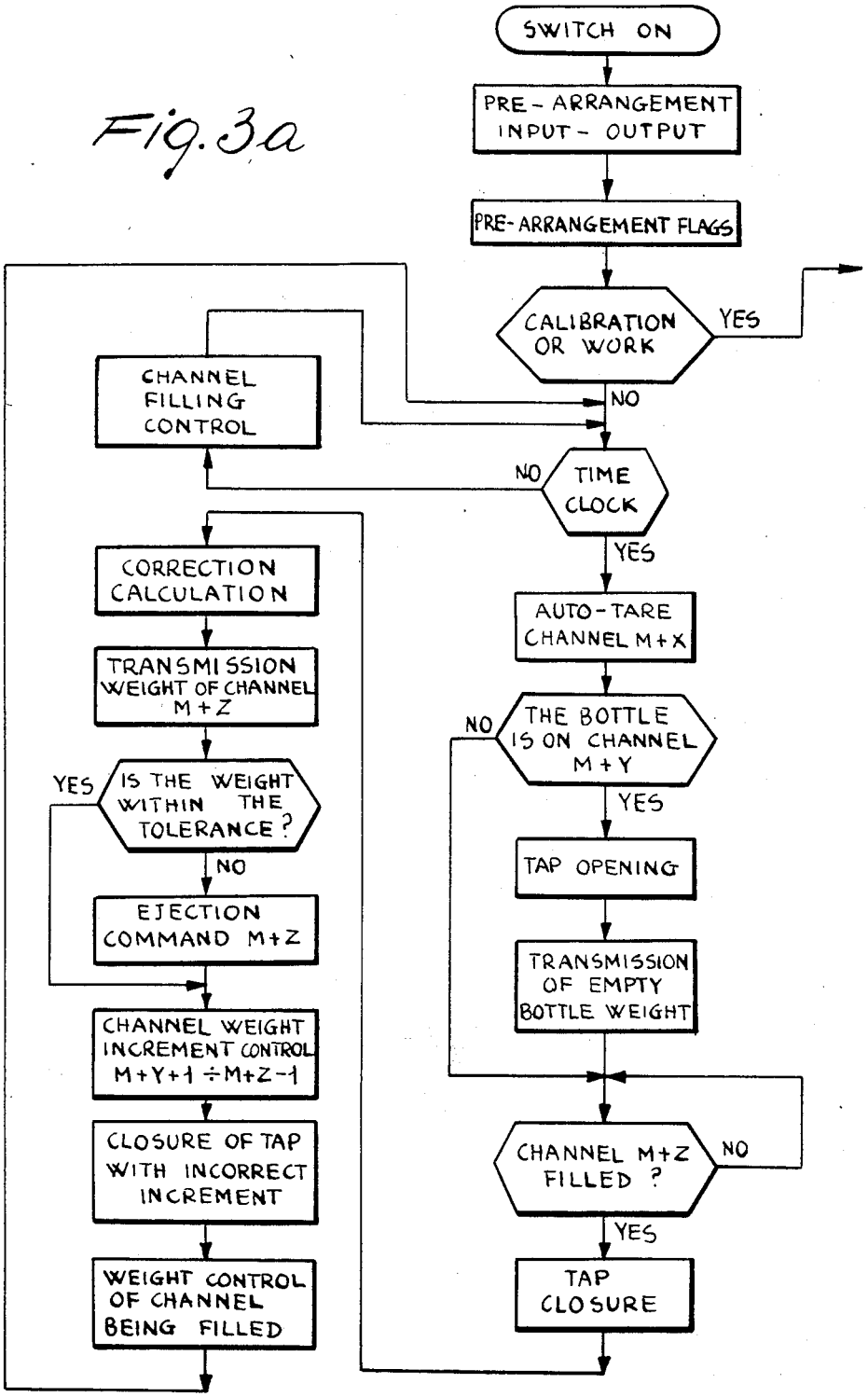

For a better understanding of the operation of the system shown in FIGS. 1 and 2, reference is made to FIGS. 3*a* and 3*b*. There is shown schematically therein the operation by means of a series of blocks which permit the various operations relating to the filling system according to the invention to be effected.

With reference first to FIG. 3*a*, after the system is switched on there occurs a pre-arrangement at the input and output of the system as well as the flags, in a manner known per se. Then, the system checks the position of the switch to carry out the initial calibration or the work. If the switch is positioned to effect calibration, the method steps shown in FIG. 3*b* are carried out. In particular on a display of the led type or any other known types, there is displayed the channel or filling zone 64 which is being calibrated. At this point the system asks itself whether the operator has operated the autozero pushbutton relative to the zeroing of the tare of the empty channel, not yet loaded with the vessels or bottles to be filled. There follows then the step of acquisition of the tare formed by the weight of the empty channel, including any eventual effects due to mechanical or electrical action which could adversely affect the result. The system provides then for associating the zero value with this weight of tare with respect to which the weight of the related filling channel will then be evaluated.

The system provides then for displaying the net weight of the empty channel, i.e. zero and requests from the operator the nominal value corresponding to the net weight of the filling material. The initial calibration is carried out by resting a sample weight on the related channel and actuating the calibration pushbutton such that the system can store that sample value for use during the following filling steps. The system then displays the weight assumed for a sample and asks the operator for the setting of the next channel to be calibrated. All these operations are repeated for every channel, such that every channel is calibrated exactly eliminating any factor of the mechanical and electronic type which may individually affect the subject channel.

On completion of the calibration step for all the channels existing on the rotating carousel, the system follows the filling steps proper shown in FIG. 3*a*. In particular the system, on the arrival of a clock signal from the encoder and related channel or filling zone 64 which moves each time past a preset angular position with respect to the machine frame, which constitutes the reference for calculating the position of the various channels 64 during the carousel rotation, provides for carrying out the operations relating to the filling of the bottles arranged on a filling path and for controlling the correct deliver of the empty vessels and exact filling of the bottles causing the automatic ejection of those out of calibration. During this step, the system also provides for the evaluation of the deviation between the nominal value of the net or gross weight (material+flacon) and the real value and for calculating continuously corrective factors for controlling the closure of the taps, so as to follow any variations in the system, whether due to differences in the density of the filling material on account of temperature changes, or to take into account the thrust brought about by the falling filling material. The system also provides for checking the tare on every channel to carry out the autotare and provide for the elimination of errors in the evalutation of the weight due to any material dropped onto the plate 61 of the filling zone and which would alter the subsequent evaluations. In detail, after receiving the clock pulse from the encoder the system provides for the autotare measurement of the channel M+X, where M is the timing channel which moves each time past the previously mentioned reference position. That channel M+X has a well-defined angular position relatively to the reference position and is included between the reference position itself and the bottle loading station. Then the system moves its attention to the channel M+Y which has just gone past the loading station. During this step the presence of the bottle is checked. That check is carried out on the basis of the weight value of the channel. If that weight exceeds the autotare value obtained during the previous steps, that means that there is present the bottle 62 for which the opening of the associated tap 63 is controlled through one of the solenoid valves 21 and simultaneously the weight of the empty bottle is transmitted to the central unit 5. The latter two operations are of course omitted where the weight of the filling zone 61, after going through the loading station, is equal to the autotare, i.e. the lack of a bottle is detected. Thereafter the system checks the channel M+Z which corresponds approximately to the position where it is anticipated that the desired weight is close to being reached. That channel is monitored until a control weight value is reached which corresponds to the closing of the desired tap. Then closing of the associated tap is controlled and the calculation of the correction carried out. In practice on completion of the filling step the real net value of the filled product is measured exactly, calculated as the total weight less the tare weight and weight of the empty bottle previously stored, or the real gross weight. That weight is compared to the nominal value stored during the calibration step for that channel so as to evaluate the deviation of the real value from the nominal value. Based upon that deviation a correction factor is calculated in general obtained as a fixed percentage with respect to the error detected. The real net weight is then supplied to the central unit and compared to permissible tolerance values. If the weight appears to be out of tolerance, an ejection command is sent through the unit 10 and at the same time the previously calculated correction factor is cancelled. Then the system checks the presently being filled channels included, therefore, between the bottle loading zone and the zone where it is assumed that filling will be over. In practice the current value of the weight of every channel is compared to the value memorized during the previous cycle to check whether there occurs a correct increase in weight. That check serves the purpose of checking whether the vessel to be filled has cracks or such faults as to hinder filling or even to cause the outflowing of the product outside of the vessel. If no correct weight increase is measured, the weight remains constant or there even occurs a decrease, the related taps are controlled to closed. The system stays in the weight checking phase for the channels being filled until it receives a further clock signal from the next channel or filling zone passing the angular reference zone.

If the system fails to detect the arrival of the clock signal, that is the machine has been stopped by the operator and does not continue to rotate, the system provides for the completion of the filling of the channels located in the filling zone until the operation is completed and operation is restored by the operator or until the necessary operations are carried out.

From the foregoing it is clear that the load cells 1 define a plurality of weighing means each associated to a respective filling zone for determining at least a first empty container weight of the respective container at a first instant of time, a second filling weight at a second instant of time, later than the first instant of time, with the respective filling tap in open condition, and a third final weight at a third instant of time, later than the second instant of time with the respective filling tap in closed condition; while the central processing unit comprises memory means for storing a predeterminated nominal weight amount of fluid to be supplied and a control weight value for controlling closure of said filling taps; subtraction means for determining a filling net weight and a final net weight from the second filling weight and the third final weight, respectively, and said first tare weight, weight comparing means for comparing the control weight and the net filling weight and for generating a closure comand for the filling tap control means when the control weight and the filling net weight are equal; correction determining means including further subtraction means for subtracting the final net weight from the nominal weight amount and determining a difference weight; multiplier means for multipling the determinated difference weight for a fixed percentage factor and determining a correction factor; and third subtraction means for subtracting the correction factor from the control weight.

Furthermore the apparatus according to the invention comprises tolerance comparing means for comparing the nominal weight and final weight against a predeterminated acceptable tolerance and ejection means 10*a* for ejecting a container when the difference between the nominal weight and the final net weight is greater than said predeterminated acceptable tolerance.

Moreover the weighing means comprises means for determining a fourth tare weight at a fourth instant of time earlier than the first instant of time, and the correction determining means further comprises comparing means for comparing the fourth tare weight and the first empty container weight and generating a disable command for the filling tap control means upon detection equality between fourth and first weights.

The data relating to the number of bottles ejected due to being out of tolerance, with respect to the errors between the nominal value and the real value of the filling material weight, the number of the filled flacons, the weight of the same and all the data relating to the system's productivity are supplied by the system according to FIG. 1, through the channel 15, to the external system of FIG. 2 which picks them up as they are delivered from the system of FIG. 1 and processes them so as to be able to output the consultive data relating to the connected filling machine. Such data will be then processed and supplied at a preset rate, e.g. daily, weekly, or monthly, to monitor the operation of the filling machine.

Furthermore, to the external system is also supplied all the data of machine stop both as obtained automatically from the machine in the event of an automatic stop, and following manual stopping by the operator with specification from the latter of the reason that caused the stop. Also these data may be processed to provide consultive data for evaluating the machine efficiency.

As may be noted from the foregoing description, the invention fully achieves its objects. In fact, a system has been provided for controlling the operation of the filling machine which can perfectly follow all the variations which might lead to an improper operation of the machine. In particular, owing to the fact that, for every rotation of the carousel, the deviation between the nominal value sought and the obtained value is calculated, and from this deviation it is possible to get a corrective factor whereby the tap closing solenoid valves are controlled in an exact manner, it is possible to continuously follow the variations in density, temperature, and to always take into exact account the thrusts due to the falling filling material. In fact, if an excessive weight has been measured, a corrective factor is calculated so as to subtract it from the set control weight value for that channel to control the tap to closed. Consequently at the next revolution that channel will be closed slightly in advance, and in that way it becomes possible to closely approach the desired nominal weight value with a fast response and in a fully automatic manner such as was not possible heretofore.

Furthermore, it is extremely advantageous that the channels are calibrated for every rotation of the carousel. That fact allows to eliminate the influence of external factors, such as the weight of any material that spilled in the previous filling, electric drifts or any other factor, which would alter the end result.

Furthermore, a reliable system has been provided for checking the presence of the bottle immediately after the self-calibration so as to prevent improper operation in the absence of the bottle and to be able to calculate the tare due to the bottle in an exact way.

Extremely convenient and reliable is also the fact that the initial calibration, or inputting of the nominal values of the system, is carried out through the use of sample weights, so as to ensure an exact and accurate storing of the nominal value.

Lastly of particular importance is the checking of the exact weight increments of the filling channels, so as to be able to detect and arrange timely for problems connected with mis-formed shape of the vessel which may cause spillage of the material from the vessel onto the filling channel or adjacent areas. This fact allows avoidance of the filling material continuing to flow out of the tap, without ever reaching the nominal weight.

The invention so conceived is susceptible to many modifications and variations, without departing from the invention scope. In particular the system may be further refined such as by means of a monitor of the faulty channels, for which it is observed for example that there is a higher than average occurrence of out-of-tolerance containers, to control the definitive closure of the channel. Furthermore, there may be inserted all the controls that might be further required.

While the system illustrated has been typically thought out for management by a processor, it is apparent that the inventive concept could be implemented by using a series of circuits utilizing discrete components, each intended for monitoring a single channel or a much limited number of channels, to follow the optimum value of the weight relating to the control to close the tap, in spite or because of the various variable outside conditions.

We claim:

1. An apparatus for filling bottles, flacons or the like containers with a predeterminated weight amount of a fluid, comprising:

a rotating carousel;

a plurality of filling zones on said carousel for supporting each a respective container;

a plurality of filling taps each associated to one respective filing zone for supplying fluid to said respective container;

a plurality of filling tap control means each associated to one respective filling tap for opening and closing said one respective filling tap;

memory means for storing a predeterminated nominal weight amount of fluid to be supplied and a control weight for controlling closure of said filling taps;

a plurality of weighing means each associated to a respective filling zone for determining a first empty container weight of said respective container at a first instant of time, a second filling weight of said respective container at a second instant of time, later than said first instant of time, with said respective filling tap in opened condition, and a third final weight of said respective container at a third instant of time, later than said second instant of time with said respective filling tap in closed condition;

means for determining a filling net weight and a final net weight from said second filling weight and said third final weight, respectively, and said first tare weight;

weight comparing means for comparing said control weight and said net filling weight and for generating a closure command for said filling tap control means when said control weight and said filling net weight are equal;

correction determining means including means for comparing said nominal weight amount and said final net weight and for determining a corrective factor;

correction means for correcting said control weight according to said corrective factor.

2. An apparaus according to claim 1, wherein said correction means comprise subtraction means for subtracting said correction factor from said control weight.

3. An apparatus according to claim 1, wherein said correction determining means comprise subtraction means for subtracting said final net weight from said nominal weight amount and multiplier means for multipling the difference between said final net weight and said nominal weight amount for a fixed percentage factor.

4. An apparatus for filling bottles, flacons or the like container with a predeterminated weight amount of a fluid, comprising:

a rotating carousel;

a plurality of filling zones on said carousel for supporting each a respective container;

a plurality of filling taps each associated to one respective filling zone for supplying fluid to said respective container;

a plurality of filling tap control means each associated to one respective filling tap for opening and closing said one respective filling tap;

memory means for storing a predeterminated nominal weight amount of fluid to be supplied and a control weight for controlling closure of said filling taps;

a plurality of weighing means each associated with a respective filling zone for determining a first empty container weight of said respective container at a first instant of time, a second filling weight of said respective container at a second instant of time, later than said first instant of time, with said respective filling tap in opened condition, and a third final weight of said respective container at a third instant of time, later than said second instant of time with said respective filling tap in closed condition;

subtraction means for determining a filling net weight and a final net weight from said second filling weight and said third final weight, respectively, and said first tare weight;

weight comparing means for comparing said control weight and said net filling weight and for generating a closure command for said filling tap control means when said control weight and said filling net weight are equal;

correction determining means including further subtraction means for subtracting said final net weight from said nominal weight amount and determining a difference weight;

multiplier means for multipling said difference weight for a fixed percentage factor and determining a correction factor; and third subtraction means for subtracting said correction factor from said control weight.

5. An apparatus according to claim 1 or 4, further comprising tolerance comparing means for comparing said nominal weight and final net weight against a predeterminated acceptable tolerance and ejection means for ejecting a container when the difference between said nominal weight and said final net weight is greater than said predeterminated acceptable tolerance.

6. An apparatus according to claim 1 or 4, wherein said weighing means comprise means for determinig a fourth tare weight at a fourth instant of time earlier than said first instant of time, said correction determining means further comprising comparing means for comparing said fourth tare weight and said first empty container weight and generating a disable command for said filling tap control means upon detection equality between said fourth and said first weights.

7. A method for filling bottles, flacons or the like containers with a predeterminated amount of a fluid on a rotating carousel having a plurality of filling zones, each filling zone being associated with a respective filling tap for filling a respective container with a predeterminated nominal weight amount of fluid, comprising for each filling zone and in cyclical sequence:

storing a control weight;

loading a container on a filling zone;

detecting a first empty container weight for said loaded container;

opening a filling tap associated with said filling zone;

detecting a second filling weight for said loaded container;

closing said filling tap when said second filling weight is equal to the sum of said control weight and said first empty container weight;

detecting a third final gross weight for said loaded container;

determining a final net weight from said third final gross weight and said first empty container weight;

comparing said nominal weight amount and said final net weight and determinig a new control weight from said stored control weight and the difference between said nominal weight amount and said final net weight, thereby the instant of time at which said filling tap is closed depends each time on the difference between said predeterminated nominal weight amount and said final net weight for a previous filling cycle.

8. A method according to claim 7, further comprising detecting a fourth tare weight before said loading a container and after detecting said first empty container weight, comparing said fourth tare weight and said first empty container weight, the method further comprising preventing opening of said associated filling tap when said first empty container weight is equal to said fourth tare weight.

9. A method according to claim 7, wherein said determining a new control weight comprises subtracting said final net weight from said nominal weight amount, calculating a correction factor from said difference between said nominal weight amount and said final net weight and subtracting said correction factor from said stored control weight.

10. A method according to claim 9, further comprising comparing said nominal weight amount and said final net weight against a preset tolerance, ejecting a filled container and cancelling said correction factor when the said difference exceeds said preset tolerance.

* * * * *